United States Patent [19]

Gordon

[11] Patent Number: 4,474,369

[45] Date of Patent: Oct. 2, 1984

[54] LONG, NARROW RESILIENT REBOUND DEVICE

[76] Inventor: Donald W. Gordon, 6061 Candlelight La., Yorba Linda, Calif. 92686

[21] Appl. No.: 372,695

[22] Filed: Apr. 28, 1982

[51] Int. Cl.[3] ..... A63B 69/00

[52] U.S. Cl. ..... 272/3; 272/100; 272/102; 272/145

[58] Field of Search ..... 272/3, 4, 56, 5 R, 56.5 SS, 272/65, 70, 100, 101, 102, 113, 145; 182/138, 139; 5/417, 420

[56] References Cited

U.S. PATENT DOCUMENTS

| | | | |
|---|---|---|---|
| 1,505,558 | 8/1924 | Grabowski | 5/420 X |
| 2,671,229 | 3/1954 | Vernier | 272/65 |
| 3,004,623 | 10/1961 | Nissen | 272/65 |
| 3,935,687 | 2/1976 | Vaughn et al. | 272/3 X |
| 3,948,515 | 4/1976 | McNeil | 272/65 |
| 4,045,021 | 8/1977 | Nissen | 272/65 |
| 4,198,045 | 4/1980 | Miller | 272/145 X |
| 4,284,271 | 8/1981 | Pettit et al. | 272/65 X |
| 4,307,879 | 12/1981 | McMahon et al. | 272/3 |
| 4,339,123 | 7/1982 | Rich | 272/65 |

FOREIGN PATENT DOCUMENTS

| | | | |
|---|---|---|---|
| 319472 | 9/1929 | United Kingdom | 272/3 |

*Primary Examiner*—Richard T. Stouffer

*Attorney, Agent, or Firm*—Knobbe, Martens, Olson & Bear

[57] ABSTRACT

A jogging track for exercising includes a resilient jogging surface that is suspended by springs between a pair of parallel frame members, to form a long, narrow path. The frame members between which the jogging track is suspended are supported by a number of reinforced tubular C-frame members that are formed of a horizontal bottom portion with vertical portions extending upward from the ends of the bottom portion, and a reinforcing bar attached between the two vertical portions. The surface of the jogging track may be either transversely or longitudinally inclined. The track may be formed into any of a number of arrangements, including both closed circuit tracks and open, linear tracks.

19 Claims, 14 Drawing Figures

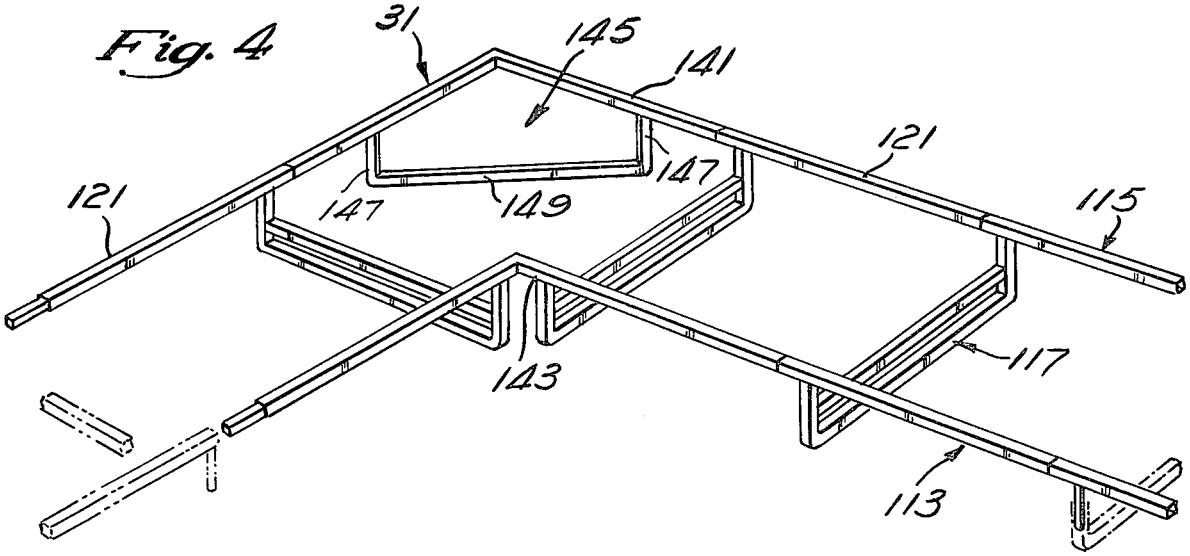
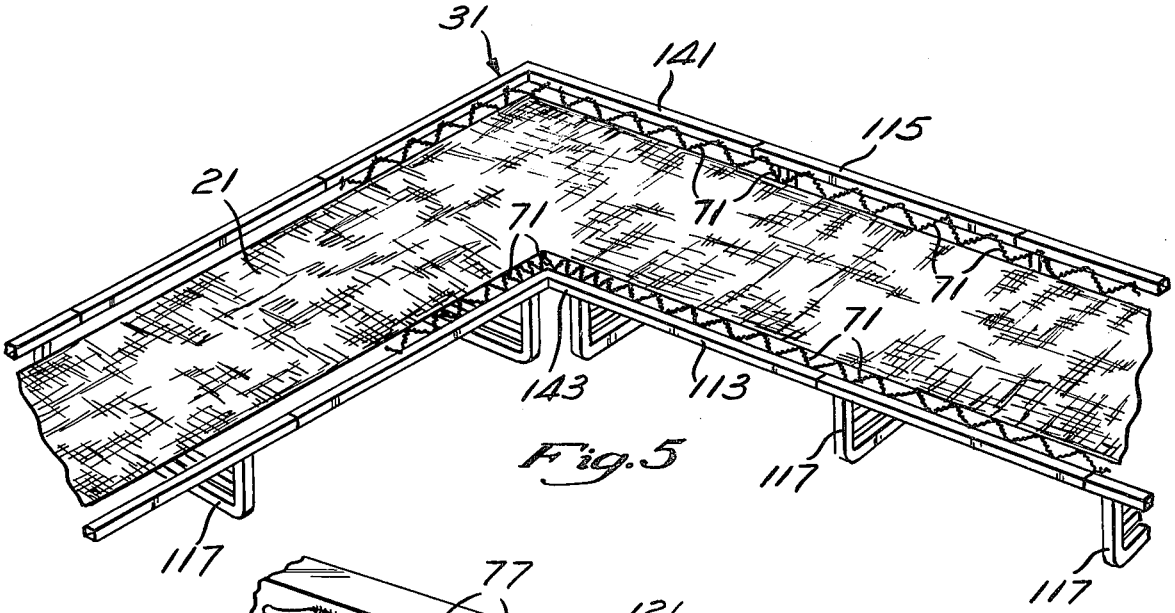
Fig. 5
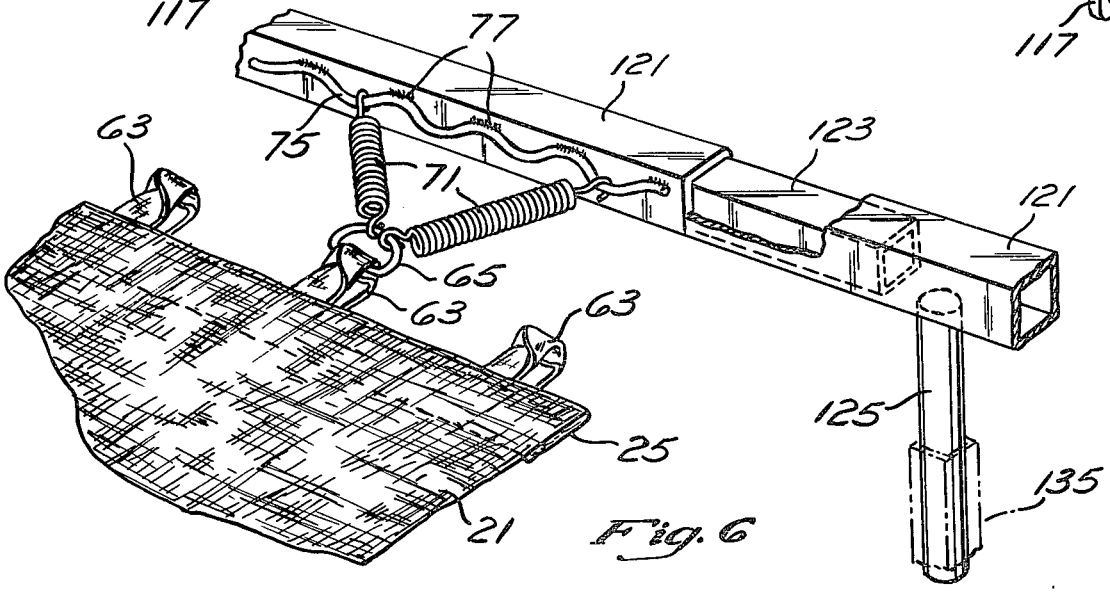
Fig. 6

Fig. 7
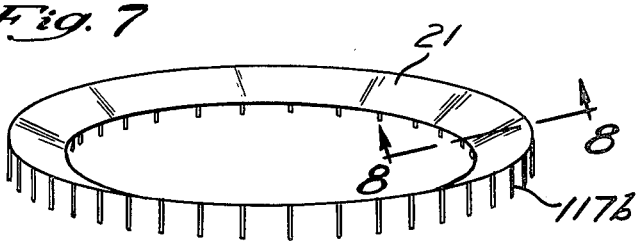
Fig. 8
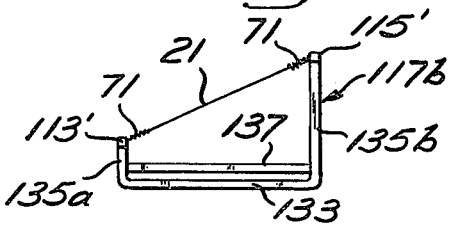
Fig. 9
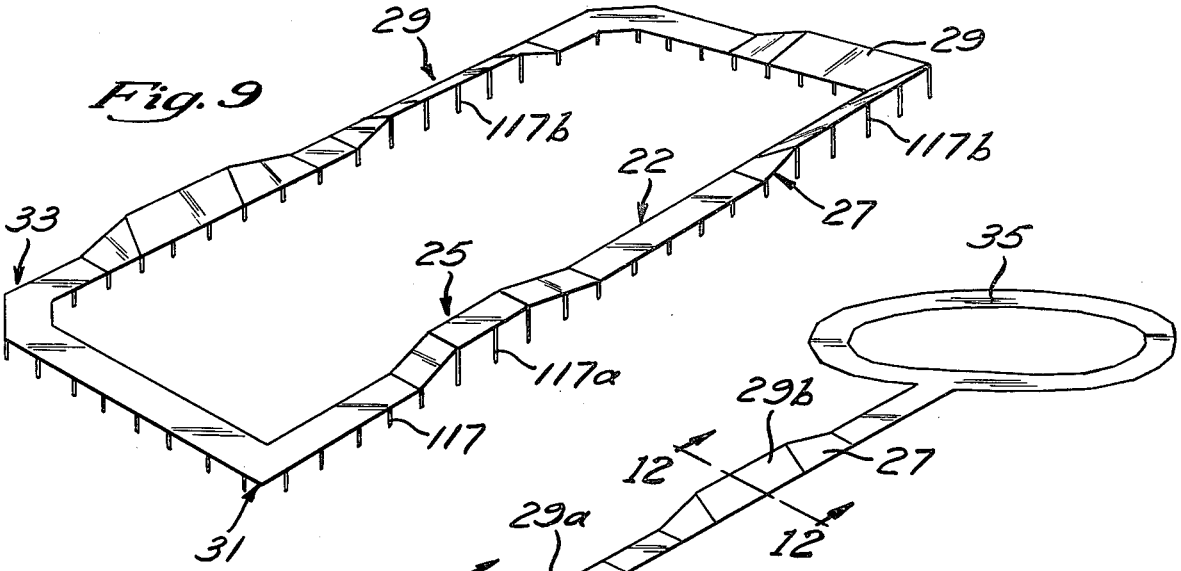
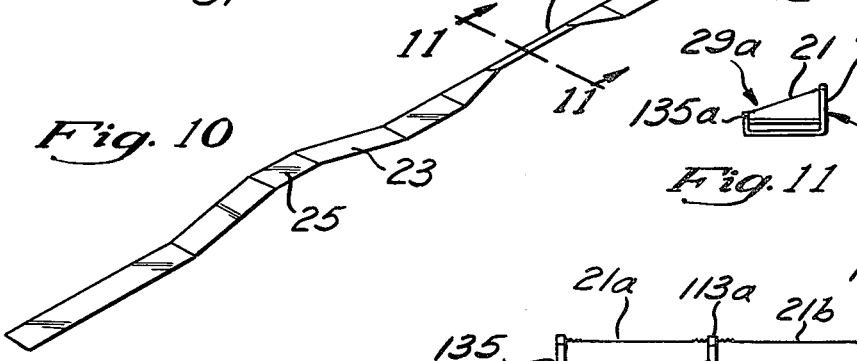
Fig. 10
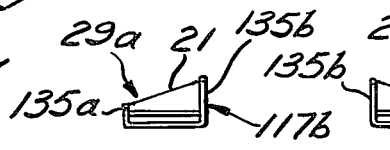
Fig. 11
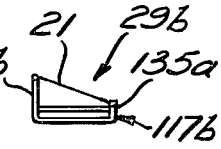
Fig. 12
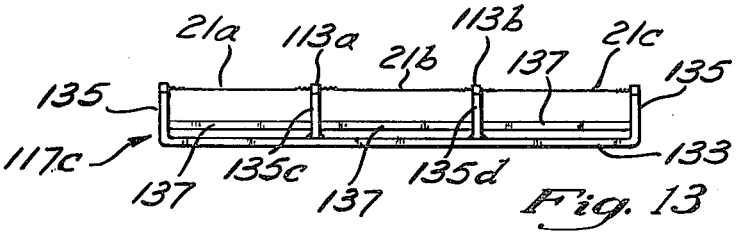
Fig. 13
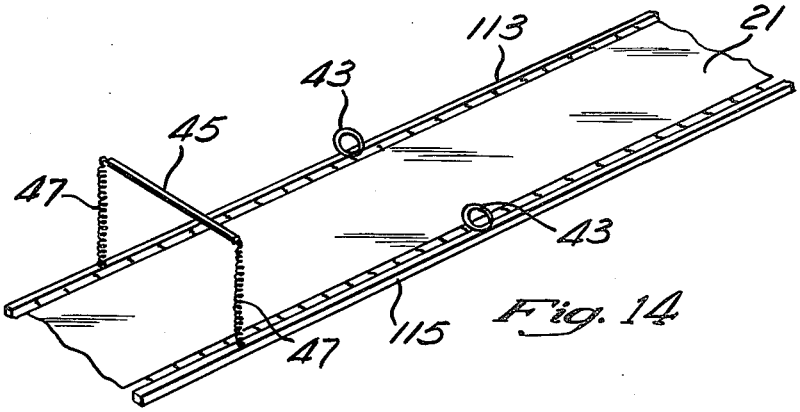
Fig. 14

LONG, NARROW RESILIENT REBOUND DEVICE

BACKGROUND OF THE INVENTION

As the importance of good health and physical exercise has received increased attention, many people have begun jogging to exercise their bodies. Jogging may be undertaken in any of a variety of locations, such as along streets and sidewalks, specially constructed tracks, or on miniature trampolines.

Jogging on streets and sidewalks and similar hard surfaces has resulted in considerable damage to the skeleton system in a substantial percentage of joggers, in addition to kidney damage in others. This damage occurs due to the considerable shock to which the body is subjected each time the jogger takes an additional stride and his foot impacts the hard surface.

Some of this damaging shock can be eliminated by jogging on somewhat softer surface tracks made of bark chips or rubber-like compounds. Nevertheless, these surfaces have a limited amount of "give" and the jogger who uses these still subjects his body to considerable shock each time he takes a stride.

Most recently, the minature trampoline has become a popular jogging surface, as it allows the exerciser to receive all the benefits of jogging, while eliminating the shock associated with jogging on a relatively hard surface. These trampolines "give" considerably each time the user's foot lands on it to eliminate the shock of the foot hitting a hard surface with each stride.

The chief disadvantage to the trampolines manufactured today is their size. The miniature trampoline joggers on the market today are typically either square or round, and are approximately 30 to 40 inches in diameter and approximately 9 inches tall. The resilient bed is connected to a square or round steel frame by springs approximately 3 inches long and spaced approximately 3 inches apart. This limited size requires the user to exercise in one place. These trampolines may also only be used by one person at a time, so they are only appropriate for home use, and not for use in commercial exercise salons. Additionally, these devices cannot be used for other exercises, such as sit-ups and jumping jacks. Many, persons are unable to do sit-ups or other horizontal position exercises on a hard surface because of their bone structures. These persons are unable to use these trampolines to realize the benefits of these exercises.

SUMMARY OF THE INVENTION

The exercise device of the present invention comprises a rebound surface whose length is substantially greater than its width so that it forms a long, narrow jogging track, and means for supporting this rebound surface above a foundation. The rebound surface is suspended between a pair of upper frame members that are supported by a plurality of reinforced C-frame members. Each reinforced C-frame member comprises a substantially horizontal bottom frame portion, a pair of substantially vertical leg portions that extend from the bottom frame portion to connect with the upper frame members, and a second substantially horizontal frame portion that extends between the vertical leg portions. The jogging track may be formed into either a straight or curved path, including a closed path.

The frame may support the jogging track surface at an angle, sloping either transverse to its length or longitudinally to give the jogger the impression of jogging on a variety of inclines to exercise various muscles in the legs.

BRIEF DESCRIPTION OF THE DRAWINGS

FIG. 4 is an enlarged perspective view of a corner in the track with the jogging surface removed.

FIG. 5 is a perspective view of a corner in the jogging track with the rebound surface attached.

FIG. 6 is an enlarged view partially in elevation and partially in cross section of the means of assembling the jogging track.

FIG. 7 is a schematic perspective view of a second embodiment of the jogging track configured as a sloped circle.

FIG. 8 is a cross sectional view taken along line 8—8 of FIG. 7.

FIG. 9 is a schematic perspective view of a third configuration of the jogging track.

FIG. 10 is a schematic view of a fourth configuration of the jogging track.

FIG. 11 is a cross sectional view taken along line 11—11 of FIG. 10.

FIG. 12 is a cross sectional view taken along line 12—12 of FIG. 10.

FIG. 13 is a cross section view of a fifth configuration of the jogging track.

FIG. 14 is a perspective view of a section of the jogging track with additonal exercise devices attached.

DETAILED DESCRIPTION OF THE PREFERRED EMBODIMENTS

Figure 1:
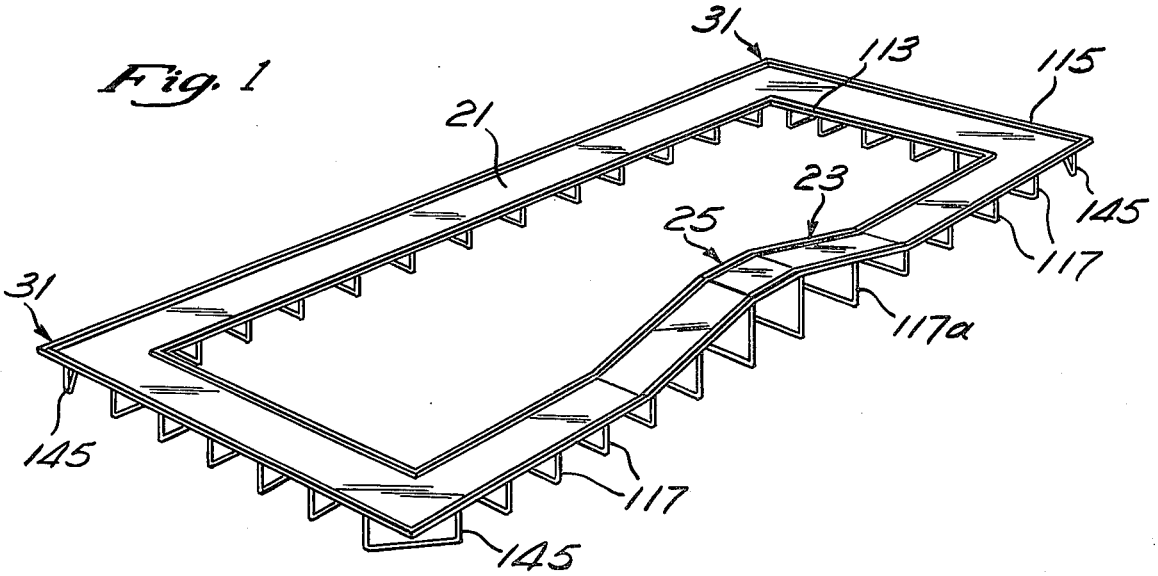
FIG. 1 is a perspective view of the jogging track assembled for use.

As shown in FIG. 1, the jogging device of the present invention includes upper frame members 113 and 115, that define between them a closed path to provide a continuous circuit. The upper frame members 113 and 115 are preferably approximately parallel and are spaced approximately 30 inches apart. The length of the upper frame members 113 and 115 are at least three times the separation between them. A rebound surface 21 is resiliently suspended between the frame members 113 and 115. The upper frame members 113 and 115 are supported above a foundation such as the ground, by support members 117 and 145. This provides a long, narrow jogging track around which a person or several persons may jog without subjecting their bodies to the damaging forces associated with jogging on a hard surfaced track or street.

Advantageously, the track includes inclined or sloped portions 23 with elevated flat portions 25 to force the jogger to use and exercise different muscles in the leg than are ordinarily used in jogging on a level surface. These inclined portions 23 are obtained by using support members 117*a* that are of a greater length than the standard support members 117 to incline the upper frame portions 113 and 115, thus inclining the rebound surface 21 that is suspended between them.

THE FRAME MEMBERS 113 AND 115

Figure 2:
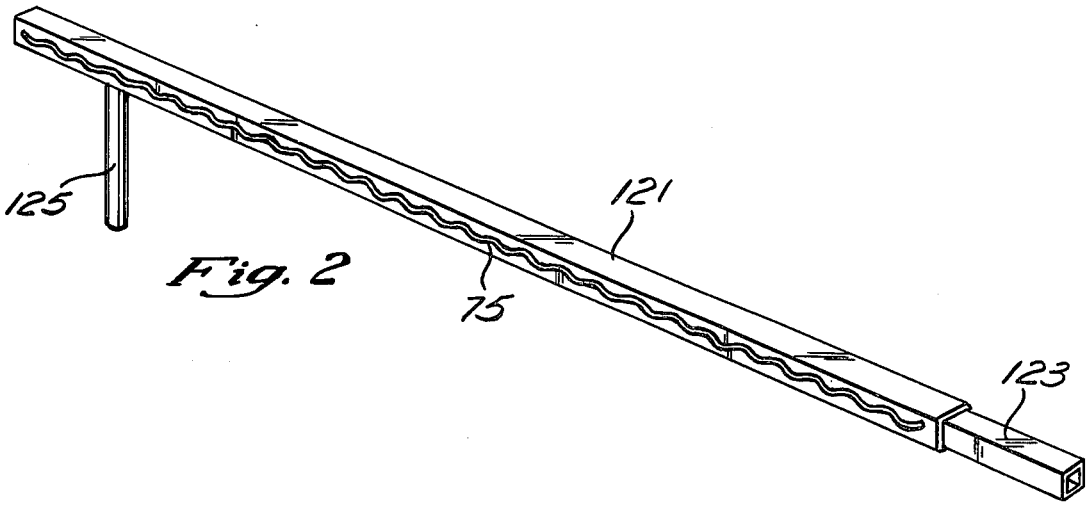
FIG. 2 is an enlarged perspective view of an upper frame element.

The upper frame members 113 and 115 are each formed by connecting in an end-to-end fashion a plurality of upper frame elements 121, one of which is shown in FIG. 2. Each of the frame elements 121 is preferably constructed of a rigid tubular material, such as steel tubing, and has a tongue portion 123 formed on one end that is smaller than the interior cavity of the tubular frame element 121. A zigzag spring attachment bar 75 is welded to the frame element 121 and a finger or depending bar 125 extends downward from the frame element 121.

Referring to FIG. 6, the upper frame members 113 and 115 are assembled by inserting the tongue portion 123 of one frame element 121 into the cavity of the tubular portion of the adjacent frame element 121. Bent frame elements 121 permit the frame members 113 and 115 to define the inclined portions 123 of the track.

SUPPORT MEMBERS 117

Figure 3:
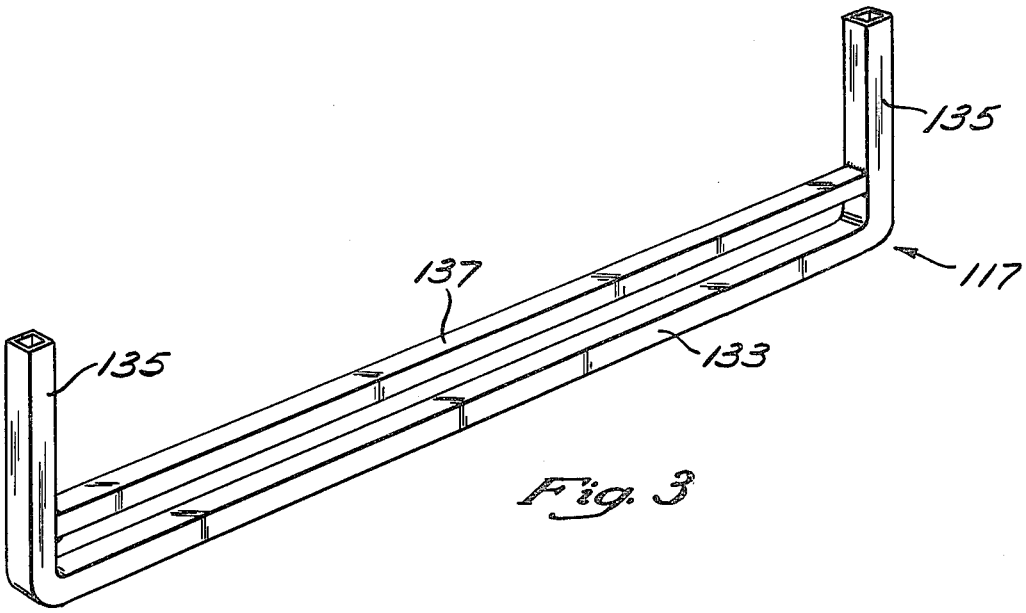
FIG. 3 is an enlarged perspective view of one of the reinforced C-frame support members.

Referring to FIG. 3, each support member 117 is preferably formed as a reinforced C-frame member that has a horizontal bottom frame portion 133, a pair of substantially vertical leg portions 135 extending upwardly from the bottom portion 133, and a second horizontal portion 137 extending between the two vertical leg portions 135 to give the support member additional strength. The leg portions 135 are spaced the same distance apart as are the upper frame members 113 and 115 so that each frame member 113 and 115 may be attached to the top of one of the leg portions 135.

The support member 117 is preferably formed of tubular material similar to that of which the frame elements 121 are formed, so that the upper ends of the leg portions 135 are open to form cavities, each of which is suitable for receiving a finger 125 that extends from a frame element 121.

As shown in FIG. 6, the upper frame members 113 and 115 are supported above the foundation by inserting the fingers 125 into the opening or cavities in the end of the leg portions 135 of the support members 117.

Sloped or inclined portions 23 of the track and elevated portions 25 are supported by support members **117*a* that are identical to the standard support members 117, except they have leg portions 135 that are longer than the leg portions 135 of the standard support members 117**.

THE CORNER ELEMENTS OF THE FRAME

The closed path shown in FIG. 1 includes several corners 31, which are advantageously right angles so the user of the device can make easy right angle turns while jogging around the track. Referring to FIGS. 4 and 5, these corners 31 are formed by including in the upper frame members 113 and 115 inner corner elements 143 and outer corner elements 141.

Each corner element 141 and 143 is formed of tubular material similar to that from which frame elements 121 are constructed, with a tongue portion of reduced size similar to the tongue portion 123, so the corner elements 141 and 143 can be assembled in an end-to-end relationship with the other frame elements 121 to form a corner in the path. Each corner element 141 and 143 is formed of two elongate portions connected to one another to form between them an angle.

Attached to outer corner element 141 is support member 145, which preferably comprises a bottom portion 149 and two vertical leg portions 147. The support member 145 is preferably formed also of a rigid tubular material so that the upper ends of the leg portions 147 are open to receive fingers (not shown) that depend from each of the elongate portions of the outer corner element 141. These fingers are substantially identical to the fingers 125 that depend from the frame elements 121 and fit into the open upper ends of the leg portions 147 in the same manner that the fingers 125 fit into the leg portions 135 of the support members 117.

Because the support member 145 is subjected to less stress than the support members 117, the support member 145 does not need a second horizontal frame portion similar to the portion 137 of the support member 117.

SUSPENSION OF THE REBOUND SURFACE

Referring to FIG. 5, the rebound surface 21 is suspended resiliently between the upper frame members 113 and 115 by means of a plurality of coil springs 71 connected between the frame members and the rebound surface. These springs 71 are sufficiently taut that the rebound surface 21 suspended between the frame members 113 and 115 has a rebound factor of at least 20%, and preferably 30%, so that when an object is dropped on the rebound surface 21 it returns to a height of at least 20% of the height from which it was dropped. The rebound surface 21 forming the jogging track is preferably made as a single piece of fabric material so the rebound characteristics are as uniform as possible.

The details of the attachment between the frame elements 21 of the frame members 113 and 115 is shown in FIG. 6. A length of a zigzag bent bar 75 is welded to the frame element 121 at points 77 to form between weld points 77 openings through which the end of the spring 71 may be placed to attach the spring 71 to the frame element 21.

The lateral edges of the rebound surface 21 are folded over to form reinforced portions 25, to which are attached loops 63. These loops 63 are advantageously formed of seat belt webbing or similarly strong material. Through each of these loops is placed a ring 65 through which the other end of the spring 71 may be inserted. As the track is assembled, a multitude of springs 71 are connected between the rings 65 and the zigzag bar 75 along the length of the track.

Most advantageously, a pair of springs 71 connect each of the rings 65 to the frame element 121, so each spring is stretched diagonally between the ring 65 and the zigzag bar 75. This increases the tension on the rebound surface 21, which improves its rebound characteristics, and allows the use of a wider rebound surface 21, which gives the user a wider track on which to exercise; reducing the possibility of the user's foot slipping between the surface 21 and the frame member.

Referring to FIG. 5, it is seen that near the corner 31 of the track the springs 71 connecting the rebound surface 21 to the inner corner element 143 of the upper frame member 113 are placed closer together than the springs 71 connecting the rebound surface 21 to the outer corner element 141 of the upper frame member 115. Since the perimeter of the outside of the corner is larger than the perimeter of the inside, the increased concentration of the springs 71 on the inside of the corner 31 helps ensure that the tension placed upon the rebound surface 21 is approximately evenly distributed between the inside and the outside.

The springs 71 connecting the rebound surface 21 to the upper frame members 113 and 115 are also placed closer to one another near the top of the inclined portions 23. Alternatively, the springs 71 near the top of the inclined portions 23 may be springs having a higher spring constant than the other springs 71. This ensures that the rebound characteristics of the jogging track remain relatively constant along its entire length, and the performance of the rebound surface 21 does not change materially near the top of the inclined portion 23.

Virtually all of the resilient support for the rebound surface 21 is provided by the springs 71 connected to the lateral edges of the rebound surface 21. The length of the rebound surface 21 greatly exceeds its width, generally by a factor of at least 10 times, and often by as much as 50 or 100 times. Because the rebound surface 21 is only approximately 18 to 22 inches wide, and the tension provided by the springs 71 is quite high, the lack of a significant amount of tension in a longitudinal direction does not adversely affect the rebound characteristics of the jogging track.

ALTERNATE EMBODIMENTS

Using the frame elements and attachment means disclosed above, a variety of jogging tracks may be assembled to accomplish a variety of exercise programs.

A variation shown in FIG. 7 includes the rebound surface 21 supported at an angle by a plurality of support members **117*b*. The support member 117*b*, seen in FIG. 8, is similar to the standard support members 117, comprising a reinforced C-frame element that includes a bottom portion 113, a short leg 135, a long leg 135*b*, and a second horizontal frame portion 137. Each leg portion 135*a* and 135*b* is connected to an upper frame member 113' or 115'. These upper frame members 113' and 115' are very similar to the upper frame elements 113 and 115 of the preferred embodiment, except that they are curved so that the track formed by the rebound surface 21 suspended between them by the springs 71 forms a circular path. Also, since the legs 135 and 135*b* of the support member 117*b* are of different lengths, the upper frame members 113' and 115' are supported at different elevations, and the rebound surface 21** suspended between them to form the jogging track is supported at an angle transverse to its length. This angle should be at least fifteen degrees off horizontal.

A variation of the jogging track that uses a variety of the configurations possible with the present invention is shown in FIG. 9. Included are sloped portions 23 and elevated level portions 25 as discussed above, which are formed by using support members **117*a* that are identical in all respects to the standard support members 117, except that the leg portions 135 are extended to support the frame elements 121 forming the upper frame members 113 and 115** at higher elevations or on an incline.

Additionally shown are sloped portions 29 and ramp portions 27 forming the transition between the level portions 22 and the sloped portions 29. Each of the ramp or sloped portions 27 and 29 are supported by support members **117*b* like the one shown in FIG. 8 which have one leg portion 135*b* longer than the other leg portion 135*a* to maintain one lateral edge of the rebound surface 21** at a higher elevation than the other lateral edge. The variety of slopes and inclines in this jogging track configuration forces the user to exercise various muscles in the legs differently from merely jogging on a level surface.

In addition to the right angle corners 31 already discussed, the track shown in FIG. 9 includes several approximately 45° angles 33. These are formed in the track in the same manner as the right angles 31, except that the elongate portions of the corner elements meet each other to form 45° angles, rather than 90° angles. It should be understood that other angles as desired may be formed in the same manner.

A variation possible with the present invention is a single elongate track such as the one shown in FIG. 10, rather than the closed loop track previously discussed. This track could include inclined portions 23 with elevated portions 25, as well as sloped or banked portions **29*a* and 29*b*. The end of the track could include a circular or oval section 35** that would permit the user to turn around and return the other direction on the track.

The sloped portions **29*a* and 29*b*, shown in FIGS. 11 and 12, are supported by support members 117*b* similar to the support members 117, except that the legs 135*a* and 135*b* are of different heights so that the upper frame members are supported at different elevations and the rebound surface 21** is suspended between them at an angle.

Referring to FIG. 13, for multiple persons use, several rebound surfaces **21*a*, 21*b*, and 21*c* can be suspended in parallel by using an extended support member 117*c* that has, in addition to the vertical leg portions 135 on either end of the bottom portion 133, intermediate leg portions 135*c* and 135*d*, to which are attached additional intermediate upper frame members 113*a* and 113*b***.

Additional exercises may be performed using the present invention with the use of additional devices that may be attached to the upper frame members 113 and 115. Referring to FIG. 14, a pair stirrups 43 may be attached to each of the upper frame members 113 and 115 through which the user may put his or her feet when he lies down to do sit ups on the rebound surface 21. This allows the user to use the jogging device for additional exercises as part of a complete exercise program. This is also particularly beneficial for users whose anatomy may be such that they are unable to do sit ups or other horizontal body position exercises on a hard surface.

At intervals along the track a hurdle comprising a horizontal bar 45 supported by resilient posts 47 may be placed to provide an obstacle over which the jogger must jump while traversing the track path. This gives the user additional exercise of his muscles as he seeks to jump over the hurdle, but the hurdle will not trip him if he does not clear it since it is mounted resiliently.

Other accessories may be attached to the upper frame elements 113 and 115 to permit the jogging track of the present invention to be used for a wide variety of exercise without the potentially harmful effects of a hard surface. Additionally, handrails may be attached to the upper frame members 113 and 115 adjacent the slanted or inclined portions 23, 27, and 29 so a user who loses his balance on these non-horizontal sections can steady himself.

I claim:

1. An exercise device comprising:

a frame comprising a pair of mutually spaced upper frame members defining between them a path, wherein the lengths of said upper frame members are at least ten times the separation of said upper frame members;

a long, narrow jogging track comprising a rebound surface which is substantially uniform throughout a length which is at least ten time of the width of the track and having two substantially parallel sides resiliently hung between said upper frame members said frame members supporting said surface from above when said surface is supporting a jogger; and means for supporting said upper frame members above a foundation.

2. The exercise device defined in claim 1, wherein said means for supporting said upper frame members comprises a plurality of reinforced C-frame members, each comprising:

a substantially horizontal bottom frame portion;

a pair of substantially vertical leg portions extending upwardly from said bottom frame portion, wherein the spacing between said pair of vertical legs is substantially the same as said separation between said upper frame members, and said upper frame members are connected to said vertical legs; and a second substantially horizontal frame portion extending between said vertical leg portions.

3. The exercise device defined in claim 1, wherein said rebound surface is suspended between said upper frame members by means of a plurality of rings attached to said rebound surface and a plurality of springs connected between said rings and said upper frame members.

4. The exercise device defined in claim 3, wherein a pair of said springs are connected between one of said rings and one of said upper frame members.

5. The exercise device defined in claim 1, additionally comprising:

means for attaching a band across said jogging track.

6. The exercise device defined in claim 5, wherein said band is a hurdle comprising a horizontal portion supported a distance above said jogging track by a pair of resilient stems, each connected to one of said upper frame members.

7. The exercise device claimed in claim 1, additionally comprising a pair of stirrups adapted to fit over the ankles of a person lying on said rebound surface, wherein each of said stirrups is connected to one of said upper frame members.

8. The exercise device defined in claim 1, wherein said path defines a closed curve that surrounds a central opening.

9. An exercise device, comprising:

a frame comprising a pair of mutually spaced substantially parallel upper frame members defining between them a path, said upper frame members being angled in the same direction to form a bend in said path;

means for supporting said frame members above a foundation; and rebound surface whose length is substantially greater than its width, said rebound surface resiliently hung between said upper frame members, said frame members supporting said surface from above when said surface is supporting a jogger, said surface forming a long, narrow jogging track.

10. The exercise device defined in claim 9, wherein:

each of said upper frame members comprises a plurality of elongate frame elements attached to one another in an end-to-end fashion;

one of said elongate frame elements is an inner corner element comprising two elongate portions connected to one another to form an angle;

a second of said elongate frame elements is an outer corner element comprising two elongate portions connected to one another to form an angle substantially equal to said angle formed by said inner corner element; and said corner elements are connected to other of said frame elements to define in said path a bend.

11. The exercise device defined in claim 9, wherein:

said rebound surface is resiliently suspended between said upper frame members by a plurality of springs spaced along said upper frame members; and the spacing between said springs is less along the frame member forming the inside of said bend than along the frame member forming the outside of said bend.

12. The exercise device defined in claim 9, wherein said support means comprises a plurality of C-frame members spaced along said path, wherein each C-frame member comprises a substantially horizontal bottom frame member and a pair of substantially vertical leg members, wherein one of said leg members is attached to one of said upper frame members and the other of said leg members is attached to the other of said upper frame members.

13. An exercise device, comprising:

a frame comprising a pair of mutually spaced upper frame members defining between them a path and, wherein each of said upper frame members comprises a plurality of elongate frame elements attached to one another in an end-to-end fashion wherein;

one of said elongate frame elements is an inner corner element comprising two elongate portion connected to one another to form an angle;

a second of said elongate frame elements is an outer corner element comprising two elongate portions connected to one another to form an angle substantially equal to said angle formed by said inner corner element; and said corner elements are connected to other of said frame elements to define in said path a bend;

means for supporting said frame members above a foundation;

a rebound surface whose length is substantially greater than its width, said rebound surface resiliently suspended between said upper frame members to form a long, narrow jogging track; and a C-frame member attached to said outer corner elements so that said outer corner element is supported above said foundation, wherein:

said C-frame comprises a substantially horizontal bottom frame portion and a pair of substantially vertical leg portions; and the upper end of each of said leg portions is attached to one of said elongate portions of said outer corner element.

14. An exercise device comprising:

a pair of substantially parallel upper frame members, wherein the length of said upper frame members is at least ten times the separation between them, to define a long, narrow jogging path;

a plurality of reinforced C-frame members for supporting said upper frame members, each C-frame member comprising:

a substantially horizontal bottom frame portion;

a pair of substantially vertical leg portions extending upwardly from said bottom frame portion; and a second substantially horizontal frame portion extending between said vertical leg portions; and a rebound surface which is substantially uniform throughout a length which is at least ten times the width of said surface and being resiliently hung between said upper frame members, following said path, said rebound surface having two substantially parallel sides, said upper frame members supporting said surface from above when said surface is supporting a jogger.

15. The exercise device defined in claim 14 additionally comprising a plurality of fingers extending from said upper frame members, wherein:

the upper end of each of said vertical leg portions is provided with a cavity adapted to receive one of said fingers, so that said fingers fit into said cavities to connect said frame members to said vertical legs.

16. The exercise device defined in claim 15, wherein:

said vertical leg portions are formed of tubular material; and the upper ends of said tubular leg portions are open to form said cavities for receiving said fingers.

17. An exercise device, comprising:

a rebound surface whose length is substantially greater than its width;

a frame supported at an angle with respect to a foundation for supporting said surface above said foundation so that the plane defined by said surface is not horizontal, wherein said plane has an incline of at least fifteen degrees, and wherein at least a portion of said rebound surface slopes in a longitudinal direction;

a plurality of rings attached to the lateral edges of said rebound surface; and a plurality of springs connected between said rings and said frame so that said rebound surface is resiliently suspended from said frame.

18. The exercise device defined in claim 17, wherein said rings attached to said rebound surface adjacent the top of said slope are spaced closer together than said rings adjacent the bottom said slope.

19. The exercise device defined in claim 17, wherein one of said springs connected to one of said rings adjacent the top of said slope has a higher spring constant than one of said springs connected to one of said rings adjacent the bottom of said slope.

* * * * *